US005082145A

United States Patent [19]

McDonald

[11] Patent Number: 5,082,145

[45] Date of Patent: Jan. 21, 1992

[54] WINE CASK RESTRAINING ACCESSORY

[76] Inventor: William J. McDonald, 35 Neilsen Crescent, Bundoura, Victoria 3083, Australia

[21] Appl. No.: 566,368

[22] PCT Filed: Dec. 30, 1988

[86] PCT No.: PCT/AU88/00503

§ 371 Date: Aug. 15, 1990

§ 102(e) Date: Aug. 15, 1990

[87] PCT Pub. No.: WO89/06627

PCT Pub. Date: Jul. 27, 1989

[30] Foreign Application Priority Data

Jan. 13, 1988 [AU] Australia ..... PI6286

[51] Int. Cl.[5] ..... B65D 25/00

[52] U.S. Cl. ..... 222/105; 222/106; 222/192

[58] Field of Search ..... 222/105, 106, 192

[56] References Cited

U.S. PATENT DOCUMENTS 4,143,795 3/1979 Casebier ..... 222/143 OR 4,974,748 12/1990 Rae ..... 222/106 X

FOREIGN PATENT DOCUMENTS 2908654 9/1980 Fed. Rep. of Germany ..... 222/105

2188305 9/1987 United Kingdom ..... 222/105

*Primary Examiner*—Michael S. Huppert

*Assistant Examiner*—Anthoula Pomrening

*Attorney, Agent, or Firm*—Foley & Lardner

[57] ABSTRACT

A wine cask accessory comprising a shaped plate (1) having a pair of depending leg portions (2,3) disposed on either side of the shaped opening (4) having an innermost portion (5) which is shaped to receive the most common sizes of wine cask valve (V), the leg portions (2,3) on the opening (4) being dimensioned such that the leg portions project below the bottom of the wine cask (C) when the opening portion (5) is engaged with the valve (V) of the wine cask. The plate (1) may be formed with a crown sealed bottle opener (15, 16), a twist-off bottle cap opener (20, 21, 22), a can opener (12,13), a screw-top cap opener (17, 18, 19), a cork screw (23,24) and a plastic bottle cap remover (27, 28). The accessory functions to prevent displacement of the cask valve (V) inwardly of the container in use and the leg portions (2,3) engage the edge of a supporting surface to prevent movement of the cask with respect to the supporting surface.

8 Claims, 1 Drawing Sheet

WINE CASK RESTRAINING ACCESSORY

FIELD OF THE INVENTION

This invention relates to restraining accessories for use with wine casks and other "bag-in-box" packages having a dispensing valve which projects through an opening in an outer container.

BACKGROUND OF THE INVENTION

Wine casks, and particularly large wine casks, occasionally develop a problem in which the valve is displaced inwardly of the container in use. This often occurs after a cask has been in a refrigerator for a long period, thereby softening the cardboard surrounding the valve.

It is also sometimes difficult to restrain a cask on a table top while the valve is actuated since one hand must hold the glass to be filled while the other hand must be used to acutate the valve. This difficulty often results in the cask slipping inwardly of the table edge thereby resulting in inconvenient spillages.

While Australian Patent Application AU-A51077/85 overcomes the first mentioned problem, it does not overcome the second mentioned problem. Other cask clamping plates for use with wine cask coolers, for example as shown in Australian Registered Design 92558, also overcome the first mentioned problem but do not overcome the second mentioned problem.

SUMMARY OF INVENTION AND OBJECTS

It is an object of the present invention to provide a wine cask accessory which overcomes or ameliorates the second mentioned problem.

The invention accordingly provides a device for restraining a wine cask or the like having a dispensing valve projecting through an opening in an outer container, said device having a portion or portions which extend below the bottom of the outer container when the device is in use, whereby the portions may engage the edge of a supporting surface to prevent movement of the cask with respect to the supporting surface.

The device preferably has a further portion which in use engages the dispensing valve of the cask to inhibit withdrawal of said valve into said outer container, said further portion being positioned such that said portion(s) extend below the bottom of said outer container when engaged with said dispensing valve.

In one form the device comprises a substantially flat plate having an opening dimensioned to receive the valve of the cask whereby portions of the plate around the opening engage behind the valve in use, said plate being shaped to provide said portions which extend below the bottom of said outer container when said opening is aligned with said valve.

In its simplest form, the flat plate may be generally rectangular in shape and has an elongate generally rectangular opening formed centrally therein, said rectangular opening having a depth such that when the plate engages behind the dispensing valve, portions of the plate on either side of the opening extend below the bottom of the cask to enable engagement between such portions and the edge of a supporting surface.

In a preferred form of the invention, the flat plate is formed with means for opening crown seal bottle caps, and for opening twist-off bottle caps and may also support a cork screw as well as a device for opening and closing screw caps.

While it is presently intended that the device be used as an accessory for use with wine casks and the like, it should be appreciated that the invention is equally applicable to devices which form part of or are attached to or inserted in the outer container of the cask.

BRIEF DESCRIPTION OF THE DRAWINGS

A presently preferred form of the invention will now be described with reference to the accompanying drawings in which.

DESCRIPTION OF PREFERRED EMBODIMENT

Figure 1:
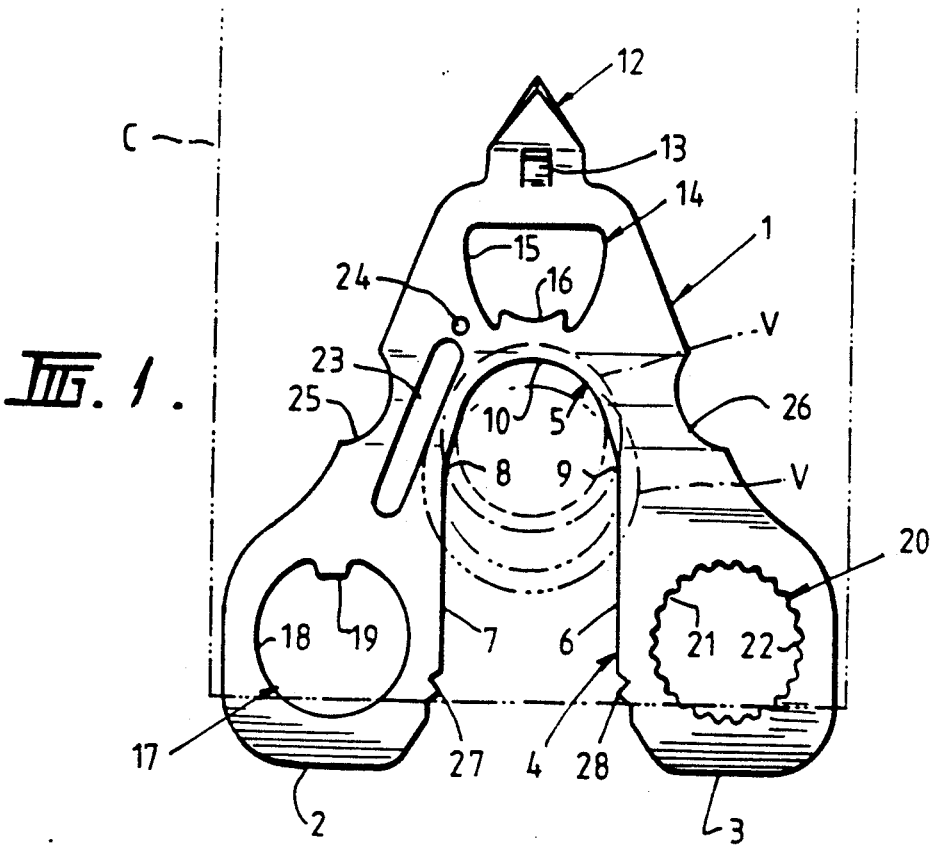
FIG. 1 is a front elevation of an accessory embodying the invention.

Referring firstly to FIG. 1 of the drawings, the cask accessory embodying the invention will be seen to comprise a shaped plate 1 having a pair of depending leg portions 2,3 disposed on either side of a shaped opening 4 having an innermost portion 5 which is shaped to receive the most common sizes of wine cask valve, which are shown in broken outline in FIG. 1 of the drawings. Thus, the opening 4 includes parallel side portions 6 and 7 which extend to points 8 and 9 from which the inner portion 5 extends inwardly to an arcuate end portion 10 having a diameter smaller than the distances between the side portions 6 and 7.

The dimensions of the opening 4, and the consequential dimensions of the leg portions 2 and 3 are such that when the plate 1 engages a valve V of a wine cask C (see FIG. 2), the leg portions 2 and 3 extend below the bottom B of the wine cask C whereby the leg portions 2 and 3 may engage the edge E of a supporting surface S on which the wine cask C is supported.

Figure 2:
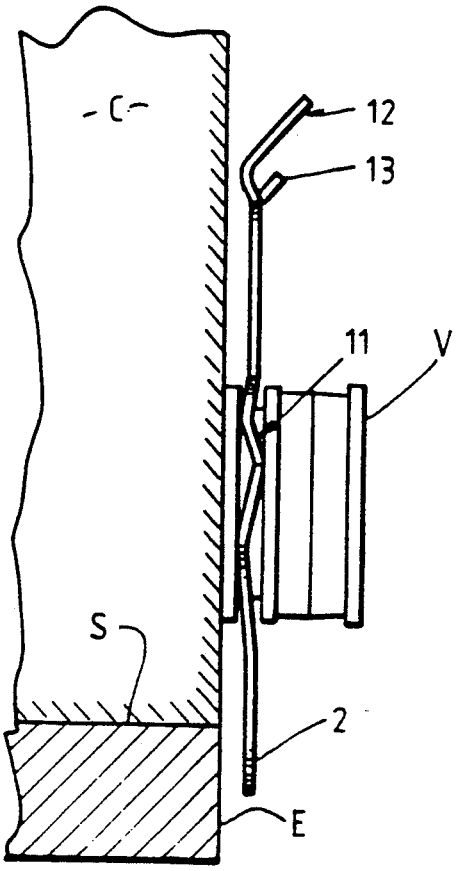
FIG. 2 is a side elevation of the accessory in use restraining a wine cask.

To provide the plate 1 with the required depth to positively engage the neck N of the wine cask valve V, the plate 1 is formed with transversely extending indentations 11, which will be most clearly seen in FIG. 2 of the drawings. In the present embodiment, the plate 1 may be press formed into the shape shown from sheet metal, although the accessory may equally well be molded from a plastics material of suitable hardness.

To maximize the functions performed by the accessory embodying the invention, the plate 1 is shaped at its upper end to provide a can opener 12 having the usual tongue 13 for engaging under the rim of the can during the end puncturing operation. Immediately below the can opener 12, a crown seal opener 14 comprising an opening 15 and a projecting lug 16 for engaging under the edge of the crown seal is formed in the plate 1.

In each leg 2,3 there is respectively formed a screw top opener 17 comprising an opening 18 and a screw top engaging lug 19, and a twist top opener 20 comprising an opening 21 having a series of closely spaced inwardly projecting undulating ribs 22 which are dimensioned to engage the indentations formed in a twist top seal.

In addition to the above, the plate 1 is formed with an opening 23 adapted to receive a cork screw (not shown) which is anchored in a circular opening 24 formed adjacent the end of the elongate opening 23.

The plate 1 is also formed with indentations 25,26 in either side of the plate to provide convenient finger grips for the installation of the accessory onto the wine cask valve V. The opening 4 is also formed with pointed extensions 27,28 which may be used to open plastic screw tops on plastic softdrink bottles.

While the shape of the plate 1 shown in the drawings is currently preferred, it will be appreciated that this shape is dictated largely by the numerous functions the accessory is intended to perform. Thus, if the accessory were to be manufactured to perform only the wine cask restraining function described above, a generally rectangular plate having a generally rectangular central opening, or an opening similar to the opening 4 described above, would be adequate for the intended purpose. Similarly, where the plate is not manufactured from pressed metal, it may conveniently be molded from plastics having a depth suitable to positively engage the wine cask valve V in the manner shown in FIG. 2 of the drawings.

While the preferred embodiment has been described as being constituted by a separate accessory which at least performs the wine cask restraining function described, it should be appreciated that the invention is equally applicable to a means integrally formed with the outer container of the wine cask or the like to perform the cask-restraining function described above. In such circumstances, the invention may be realized by the formation of tabs extending from one edge of either the side or bottom panel defining the outer container of the wine cask and of sufficient dimensions to engage a supporting surface for the wine cask. Alternatively, the invention may be realized by means of a cardboard panel mounted within the outer container of the wine cask and slidably engaging an opening between the side and end panels defining the outer container in a manner which enables the panel to be exposed beyond the lower edge of the bottom of the outer container to engage the edge of a supporting surface. In this arrangement, the panel may be suitable formed to additionally engage the valve of the wine cask in a manner similar to that described above to prevent withdrawal of the valve when the panel is in the operative position preventing movement of the cask relative to the supporting surface.

I claim:

1. In combination, a restraining device and a liquid containing cask including an outer container and an inner liquid containing member having a dispensing valve which in use projects through an opening in said outer container, said restraining device having a first portion formed with means which in use engages the dispensing valve of said cask to inhibit withdrawal of said valve into said outer container, and one or more second portions which extend from said first portion and having dimensions which in use position said second portion or portions below the bottom of the outer container when said first portion is engaged with said dispensing valve, whereby said second portion or portions can engage the edge of a supporting surface for the bottom of the outer container to prevent movement of the cask with respect to the supporting surface in at least one direction.

2. The combination of claim 1, wherein said first and second portions are formed as part of a plate having an opening dimensioned to receive the valve of a cask whereby portions of said plate around said opening engage behind the valve, said plate being shaped to provide said second portions which extend below the bottom of said outer container when said opening is aligned with said valve.

3. The combination of claim 2, wherein said plate is formed with a central elongate generally rectangular opening dimensioned to engage either side of the dispensing valve of a cask.

4. The combination of claim 3, wherein said opening has an arcuate inner end having a diameter less than the width of the opening whereby said inner end is able to engage a cask valve of smaller diameter than the width of the opening.

5. The combination of claim 2, wherein said plate is formed with means selected from one of means for opening crown seal bottle caps, means for opening twist-off bottle caps, means for puncturing the ends of cans, means for removing crown seals, means for removing corks from bottles, and means for removing caps from plastic bottles.

6. The combination of claim 5, wherein said device is fabricated from die-cut and pressed sheet metal, said device being formed with transversely extending indented portions in the region of the device which engages behind the valve of the cask.

7. A cask restraining device for use with a liquid container cask having an outer container and an inner liquid container means having a dispensing valve projecting through an opening in said outer container, said restraining device comprising a substantially rigid plate formed with generally rectangular opening dimensioned such that said plate in use engages behind the valve of said cask, a pair of leg portions on either side of said opening each dimensioned to extend below the bottom of the outer container of the cask when said plate is engage behind said valve, said opening having an arcuate inner end having a diameter less than the width of the opening whereby said inner end is able to engage a cask valve of smaller diameter than the width of the opening.

8. The device of claim 7, wherein said plate is formed with means selected from one of means for opening crown seal bottle caps, means for opening twist-off bottle caps, means for puncturing the ends of cans, means for removing crown seals, means for removing corks from bottles, and means for removing caps from plastic bottles.

* * * * *